US005620092A

United States Patent [19]

Meisinger

[11] Patent Number: 5,620,092

[45] Date of Patent: Apr. 15, 1997

[54] WRENCH SET HOLDING SYSTEM

[76] Inventor: Lyle V. Meisinger, 5311 Highway 66, Plattsmouth, Nebr. 68048

[21] Appl. No.: 634,962

[22] Filed: Apr. 19, 1996

[51] Int. Cl.[6] ..... B65D 85/28; A47F 7/00

[52] U.S. Cl. ..... 206/376; 206/377; 206/443; 206/490; 211/70.6

[58] Field of Search ..... 206/376, 377, 206/378, 372, 373, 486, 490, 443; 211/70.6

[56] References Cited

U.S. PATENT DOCUMENTS

| | | | |
|---|---|---|---|
| 1,809,450 | 6/1931 | Platt . | |
| 1,830,577 | 11/1931 | Vallone | 206/376 |
| 1,869,945 | 8/1932 | Rice | 206/375 |
| 2,119,217 | 5/1938 | Rocchi . | |
| 2,181,764 | 11/1939 | Murray | 206/376 |
| 2,465,290 | 3/1949 | Sorenson . | |
| 2,541,597 | 2/1951 | Midling | 211/70.6 |
| 3,370,696 | 2/1968 | Groe | 206/376 |
| 3,414,118 | 12/1968 | Jacobson . | |
| 3,702,136 | 11/1972 | Albertson . | |
| 3,822,019 | 7/1974 | Baatz | 211/70.6 |
| 4,813,551 | 3/1989 | Kuo | 206/377 |
| 4,911,297 | 3/1990 | Suburu . | |
| 5,020,666 | 6/1991 | Barlean . | |
| 5,036,975 | 8/1991 | Chow | 206/376 |

FOREIGN PATENT DOCUMENTS

| | | |
|---|---|---|
| 2160763 | 1/1986 | United Kingdom . |

*Primary Examiner*—Bryon P. Gehman
*Assistant Examiner*—Luan K. Bui
*Attorney, Agent, or Firm*—James D. Welch

[57] ABSTRACT

A wrench set holding system which contains wrenches therein at their open jaws is disclosed. Gradually increasing dimension element and openings provide positions thereal-ong at which each wrench jaw in a set of wrenches, rests in use. A rod is also provided which can be inserted to secure a set of wrenches in place by sandwiching present wrench shanks between the rod and a primary body element or a bottom element. The wrench set holding system is economical to fabricate and easy use.

8 Claims, 3 Drawing Sheets

-5-

10
4
3
2
-5-
1h
-1-
H2
H1
8

5
1
8

H1
-8-
H3

H4
H3
1
5
8

WRENCH SET HOLDING SYSTEM

TECHNICAL AREA

The present invention relates to systems for holding wrenches, and more particularly to a wrench set holding system which in use can retain an entire set of open jaw wrenches in a manner which makes them easy to access.

BACKGROUND

Open jaw wrenches are typically available in sets which provide a multiplicity of sizes. In use, it is typical practice to store such open jaw wrenches, loose, in a tool box. However, it can be difficult to locate a particular wrench in a tool box, and inventors have provided holders for such open jaw wrenches. Patents which demonstrate such open jaw wrench holding systems are: U.S. Pat. No. 5,020,666 to Barlean, U.S. Pat. No. 4,911,297 to Suburu, U.S. Pat. No. 3,702,136 to Albertson, I.S. Pat. No. 2,465,290 to Sorenson, U.S. Pat. No. 2,119,217 to Rocchi, U.S. Pat. No. 3,414,118 to Jacobson, U.S. Pat. No. 1,809,450 to Platt and a UK Patent to Wyllie, No. 2,160,763A.

The UK 763A Patent to Wyllie, in particular, provides an approach to securing open jaw wrenches by causing open jaws thereof to project through an opening in a holding means and encompass a material element therewithin, while a lower aspect of an open jaw rests on an upper surface of said opening. Said opening can be comprised of two Rails which are angularly inclined with respect to one another so that open jaws of various sizes can be held at locations therealong at which the spacing is appropriate. Wrenches held in a UK 763A Patent system, while being presented in a convenient manner, tend to be rather loosely held therein.

Need exists for an improved wrench set holding system which serves to hold a set of open jaw wrenches in a secure manner.

DISCLOSURE OF THE INVENTION

The present invention is a wrench set holding system comprising a top element, a primary body element and a bottom element. Said top, primary body and bottom elements being merged into a continuous system such that said bottom and top elements project essentially perpendicularly from said primary body element. When said bottom element is set upon an underlying essentially horizontally oriented surface said top element, which is offset from said bottom element by said primary body element, projects essentially parallel to said underlying essentially horizontally oriented surface, while said primary body element projects essentially vertically. Said top element is of a gradually increasing dimension as said wrench set holding system is transversed from one side thereof to another, as viewed from atop thereof, and said primary body element contains a gradually increasing dimension opening below its locus of merger with said top element, with a larger dimension of said opening being located at the same side of said wrench set holding system as is located the larger dimension of said top element, as said primary body element and gradually increasing dimension opening is viewed in frontal elevation.

When each open jaw wrench in a set of open jaw wrenches is caused to simultaneously project through said gradually increasing dimension opening in said primary body element, and each grasps therewithin a portion of said gradually increasing dimension top element at a location at which the dimension thereof is equivalent to an opening of said open jaw, a lower aspect of each of said each open jaw simultaneously contacts a lower edge of said gradually increasing dimension opening in said primary body element; with the result being that each wrench of said set of wrenches is held within said wrench set holding system.

The bottom element is typically generally rectangular in shape as viewed from beneath, as is said primary body element as viewed in frontal elevation, both views being had when said wrench set holding system is positioned as described infra.

Typically, said bottom and said top elements project in opposite directions from said primary body element, as said wrench set holding system is viewed in side elevation while said wrench set holding system is positioned as described infra.

The present invention wrench set holding system further comprises means for securing said wrenches of a wrench set in said wrench set holding system, which means for securing said wrenches is typically a rod, which rod serves to sandwich shanks of said wrenches, which shanks project from said open jaws, against an element selected from the group consisting of said primary body element and said bottom element. Said rod is typically secured to said wrench set holding system by loop means, said loop means being affixed to said wrench set holding system by projection thereof through holes in one or both elements selected from the group said primary body element and said bottom element.

It is to be noted that one of a loop means can be projected through central pivot means of a rotatable means such that a larger dimension thereof is caused to force said rod to more securely sandwich said wrench shanks when caused to rotate in one direction, and to free-up sandwiched wrench shanks when caused to rotate in the opposite direction. As well, said central pivot means, when present, typically comprises a sleeve through which said loop means directly projects, and around which said rotatable means rotates in use.

The present invention can be constructed from various materials such as plastic and metal, and can be of one piece continuous construction, or consist of a number of merged pieces. In the case where metal is utilized, welding, for instance, can effect said merger.

The present invention will be better understood by reference to the Detailed Description Section of this Disclosure, with reference being had to the accompanying Drawings.

SUMMARY OF THE INVENTION

It is therefore a purpose of the present invention to provide a wrench set holding system which is easy and economical to fabricate.

It is another purpose of the present invention to provide a wrench set holding system which is easy to utilize.

It is yet another purpose of the present invention to provide a wrench set holding system that can hold a complete set of standard or metric size wrenches, and which serves to conveniently keeps said set of wrenches together, in a progressively increasing size order.

It is still yet another purpose of the present invention to provide a wrench set holding system which allows easy carrying and hanging of an entire set of wrenches.

It is still yet another purpose of the present invention to provide a wrench set holding system which provides easy access to a set of wrenches held therein, via two finger access.

It is another purpose of the present invention to provide a wrench set holding system which replaces tool box, and pouch means for holding wrenches.

It is yet another purpose of the present invention to provide a wrench set holding system which reduces the chance of loss of wrenches held therein.

It is yet another purpose of the present invention to provide a wrench set holding system which facilitates verification of return of an entire set of wrenches, when loaned out.

DETAILED DESCRIPTION

Figures 1A, 1B, 1C, 1D, 1E:
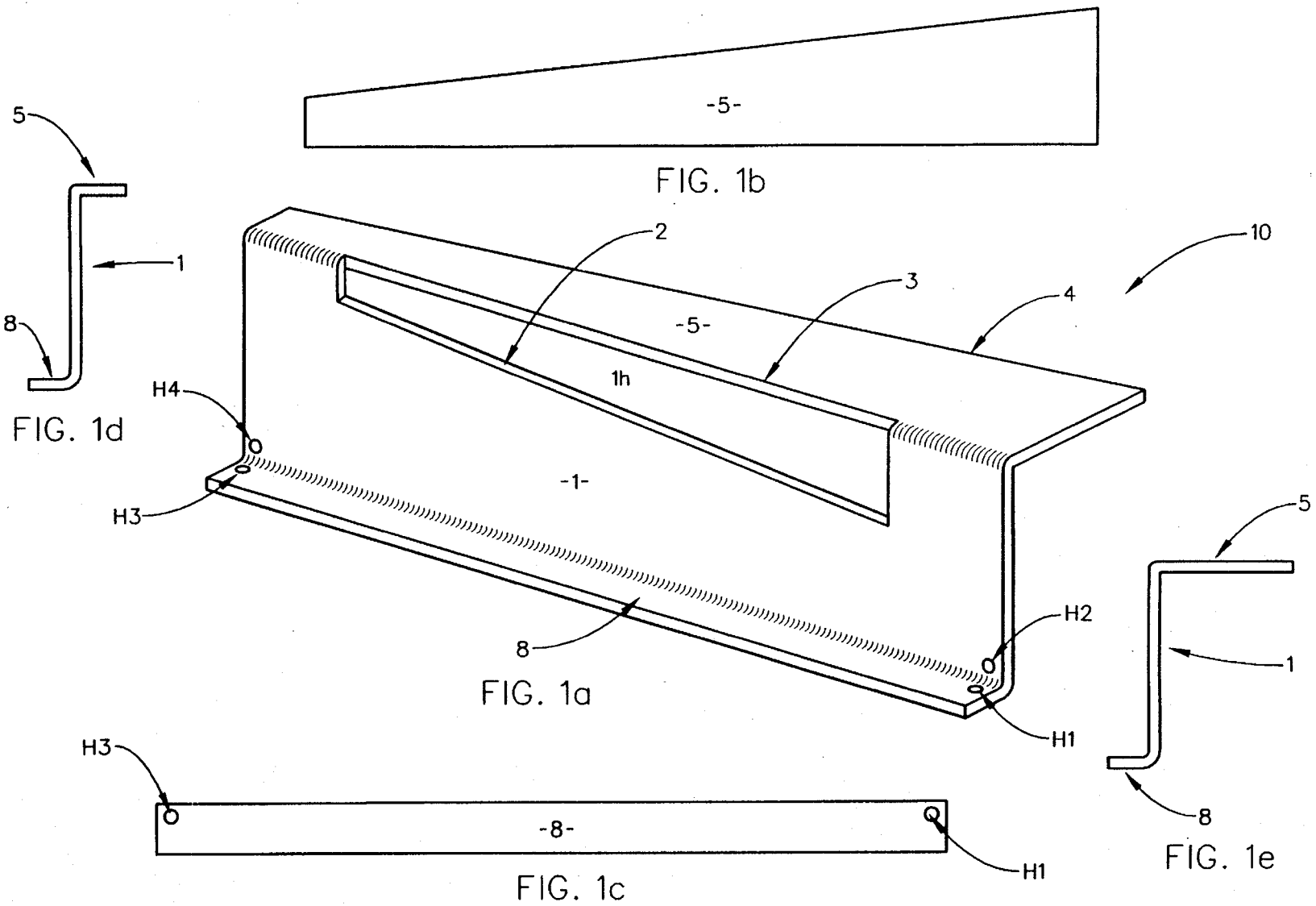
FIG. 1*a* shows a perspective view, as viewed from the upper right and in front thereof, of the present invention wrench set holding system.
FIG. 1*b* shows a top view of a top element of the present invention wrench set holding system.
FIG. 1*c* shows a bottom view of a bottom element of the present invention wrench set holding system.
FIG. 1*d* shows a left side elevation view of present invention wrench set holding system.
FIG. 1*e* shows a right side elevation view of present invention wrench set holding system.

Turning now to FIG. 1*a*, there is shown a perspective view of the present invention Wrench Set Holding System (10). Shown are the Primary Body Element (1), a Top Element (5), and a Bottom Element (8). Said Primary Body Element (1), Top Element (5) and Bottom Element (8) are shown to be interconnected to one another. Such interconnecting is a general merger which can be fashioned from a single piece of construction material, (eg. molding plastic or bending metal for instance), or by interconnection of multiple pieces such as by the welding of metal element together or gluing plastic element together, for instance. Note that Primary Body Element (1) has a Gradually Increasing Dimension Opening (1*h*) present therein, (shown increasing in dimension from left to right but which could be oriented from right to left), just below the locus of the merger between said Primary Body Element (1) and Top Element (5). Identified in FIG. 1*a* are also Lower Wrench Jaw Rest (2), Back Wrench Jaw Rest (3) and Front Wrench Jaw Rest (4), and Holes (H1), (H2), (H3) and (H4), the significance of which will become more apparent by reference to FIGS. 2*a* and 2*b*. FIG. 1*b* shows an essentially top view of the Top Element (5), FIG. 1*c* shows an essentially bottom view of said Bottom Element (8), and FIGS. 1*d* and 1*e* show essentially left and right side views of the Primary Body Element (1), Top Element (5) and Bottom Element (8). (Note that said Top Element (5) is shown increasing in dimension from left to right in agreement with the increasing dimension of the Gradually Increasing Dimension Opening (1*h*) in the Primary Body Element (1). It is to be understood, however, that said increasing dimensions could be oriented from right to left). In said FIGS. 1*d* and 1*e* the Top Elements are arbitrarily oriented to project to the right, with the Bottom Elements being arbitrarily oriented to project in an opposite, left, direction. While not a requirement of the present invention, in preferred embodiments of the present invention Wrench Set Holding System (10), the Top Element (5) and Bottom Element (8) are fashioned to project oppositely as so viewed.

Figure 2B:
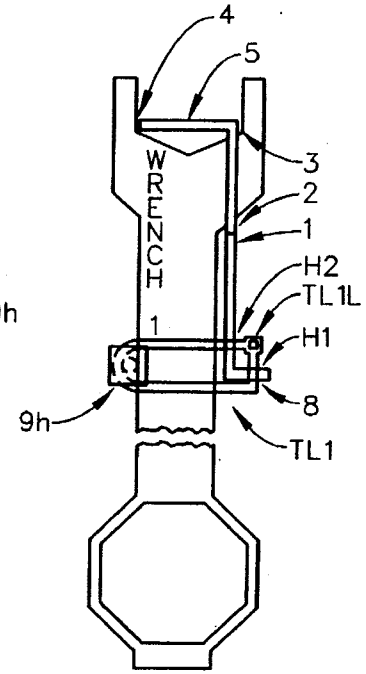
FIGS. 2*a*, 2*b* and 2*c* show front elevational, and corresponding right and left elevational side views of the system of the present invention wrench set holding system.
Figure 2A:
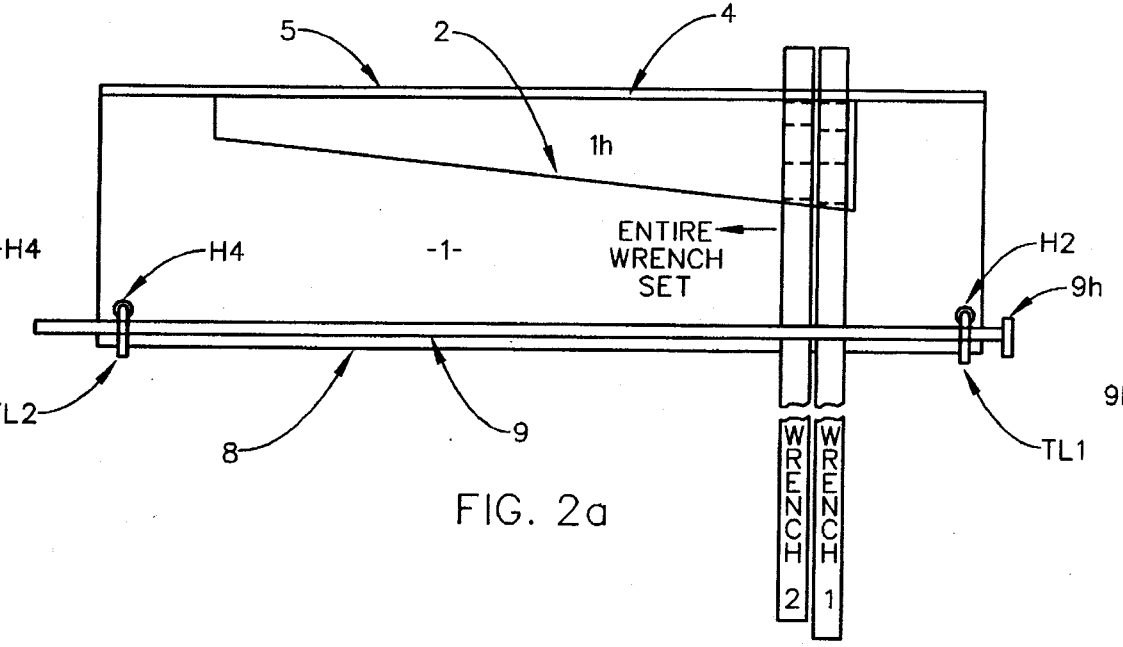
Figure 2C:
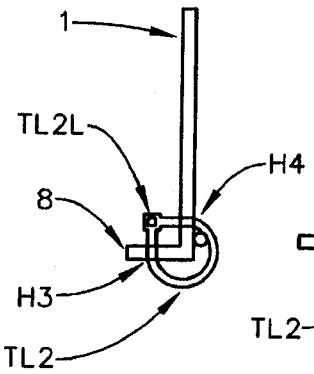
Figure 2D:
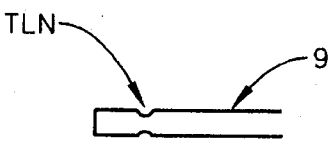
FIG. 2*d* shows a notch in the end of a wrench shank retaining rod.

Turning now to FIG. 2*a*, there is shown the Wrench Set Holding System (10) of FIGS. 1*a*–1*e* in frontal view, with two (2) wrenches shown present therein, and FIGS. 2*b* and 2*c* show essentially right and left side views thereof. Reference to FIG. 2*b* shows that the Front Wrench Jaw Rest (4) serves to engage a "Front" internal edge of a wrench Jaw placed into the present invention system, simultaneous with Back Wrench Jaw Rest (3) and Lower Wrench Jaw Rest (2) engaging the back internal edge of said wrench jaw, and an external lower edge of said wrench jaw respectively. It should be appreciated that as the Top Element (5) becomes narrower, along with the Primary Body Element Gradually Increasing Dimension Opening (1*h*), smaller jaw wrenches will be accommodated, (See Larger Jaw Wrench 1 and Smaller Jaw Wrench 2 in FIGS. 2*a* and 3*b* to better understand said arrangement). Continuing, note that FIGS. 2*a*, 2*b* and 2*c* show Tie Loops (TL1) and (TL2) are present and secured in Holes (H1) & (H2), and (H3) & (H4) respectively. Said Tie Loops (TL1) and (TL2) provide means for securing Wrenches held in the present invention Wrench Set Holding System (1), by way of a Rod (9) being inserted thereinto such that handles of present wrenches are caused to be sandwiched between said Rod (9) and said Primary Body Element (1), or perhaps a Bottom Element (8). (Note that if the Bottom Element (8) projected to the left in FIG. 2*b*, present wrench handles would contact it). FIG. 2*d* shows an expanded view of the Rod (9) at the location thereof where a Tie Loop (TL2) intercepts it. Typically a Notch (TLN) will be present thereat.

Figure 2E:
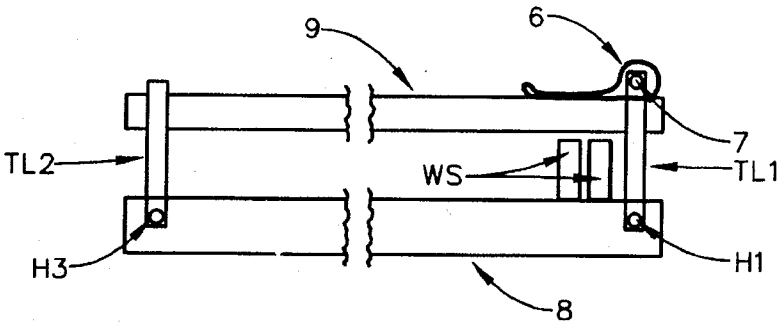
FIG. 2*e* shows a rotatable means for securing wrench shanks between a rod and a bottom element of the present invention system.

FIG. 2*e* shows a modified approach to securing a set of wrenches. A "squared-up" in shape Rod (9) is shown with its left end placed within Tie Loop (TL2) as previously described. At the right side in FIG. 2*e*, however, there is shown a Tie Loop (TL1) which secures a Rotatable Means (6) for use in securing the Rod (9) such that it sandwiches Wrench Shanks (WS) in use. Note that if said Rotatable Means (6) is caused to rotate clockwise about Center Point (7), (which Center Point (7) typically comprises a sleeve configuration around which said Rotatable means rotates in use), the Rod (9) will be forced downward by contact with a larger dimension of said Rotatable Means (6). If the shanks (WS) of a set of wrenches is present between said Rod (9) and the Bottom Element (8), it should be apparent that said shanks (WS) would become more tightly secured. It should be equally apparent that a counter-clockwise rotation of Rotatable Element (6) will free-up Rod (9) so that it can be removed to provide access to a set of wrenches positioned therebeneath. It is noted that a Rotatable means (6) could be mounted at the left side tie loop (TL2) instead of, or in addition to the Rotatable Means mounted at the right side Tie Loop (TL1) as shown in FIG. 2*e*.

Figure 3A:
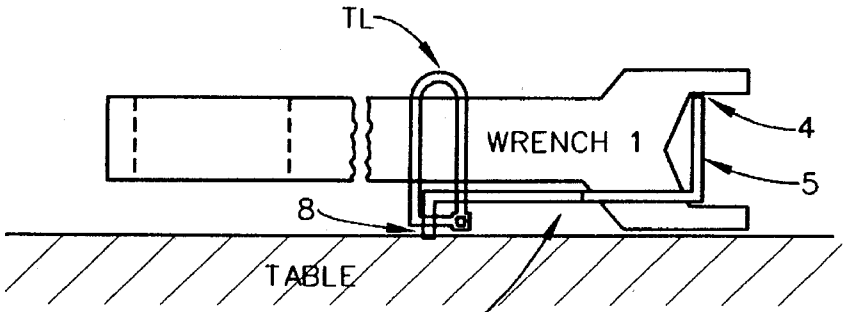
FIG. 3*a* shows a present invention wrench set holding system with a wrench therein, positioned to set upon a table to allow easy access to and use of a set of wrenches held therein.

FIG. 3*a* shows a present invention Wrench Set Holding System (10) setting on a table with Bottom Element (8) and an external edge of a back wrench jaw edge resting thereon. Note that no Rod (9) is present, hence, a user could easily access wrenches which are present.

Figure 3B:
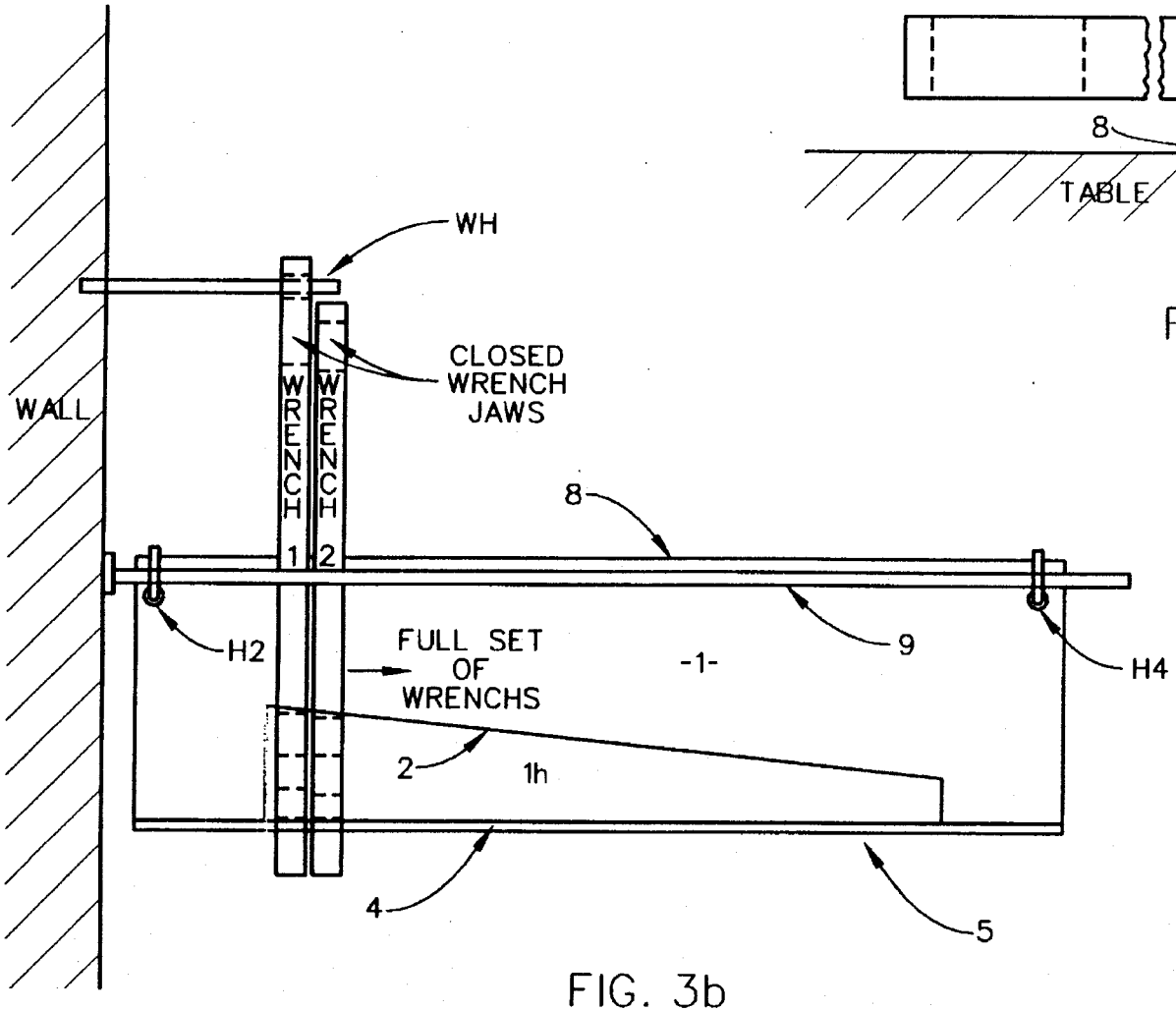
FIG. 3*b* shows a present invention wrench set holding system with two wrenches shown therein, positioned to hang from a wall by a closed jaw of a wrench present therein, to allow convenient storage of a set of wrenches.

FIG. 3*b* shows that where held wrenches have a closed jaw, the present invention Wrench Set Holding System (10) allows easy hanging of a set of wrenches secured therein on a wall from which projects a Wall Hanger (WH) projection. Note that Rod (9) is present and threaded through Tie Loops (TL1) and (TL2) in FIG. 3*b*.

It is to be understood that wrench set securing means other than a Rod (9) could be utilized in realizing the present invention and be within the scope thereof.

Finally, nonlimiting examples of wrench sets to which the present invention can be applied are those whcih span ranges of between five-sixteenth (5/16) to one-and-one-quarter (1.25) inches, and between eight (8) to twenty-four (24) millimeters.

Having hereby disclosed the subject matter of this invention, it should be obvious that many modifications, substitutions, and variations of the present invention are possible in light thereof it is therefore to be understood that the invention may be practiced other than as specifically described, and should be limited in breadth and scope only by the appended claims.

I claim:

1. A wrench set holding system comprising a top element, a primary body element and a bottom element, said top element, primary body element and bottom element being merged into a continuous system, such that said bottom and top elements project essentially perpendicularly from said primary body element and such that when an essentially downward facing surface area of said bottom element is set upon an underlying upward facing essentially horizontally oriented surface, said top element, which is offset from said bottom element by said primary body element, projects essentially parallel to said underlying essentially horizontally oriented surface while said primary body element projects essentially vertically; an upward facing surface of said top element of said wrench set holding system oriented as described, being of a gradually increasing dimension as said wrench set holding system is transversed from one side thereof to another; which primary body element contains a gradually increasing dimension opening below a locus of merger between said primary body element and said top element, with a larger dimension of said gradually increasing dimension opening being located at the same side of said wrench set holding system as is located the larger dimension of said top element; such that when each open wrench jaw in a set of wrenches is caused to project through said gradually increasing dimension opening in said primary body element and each said open wrench jaw grasps therewithin a portion of said gradually increasing dimension top element at a location therealong at which the dimension of said increasing dimension top element is equivalent to an opening dimension of said open wrench jaw, a lower aspect of each of said open wrench jaws simultaneously contacts a lower edge of said gradually increasing dimension opening in said primary body element; with the result being that when a set of wrenches is positioned within said wrench set holding systems, each wrench of said set of wrenches is held therewithin.

2. A wrench set holding system as in claim 1 in which said surface area of said bottom element which contacts said underlying essentially horizontally oriented surface when said bottom element is set upon said underlying essentially horizontal surface, is generally rectangular in shape.

3. A wrench set holding system as in claim 1, in which a surface area of said essentially vertically projecting primary body element, within which surface area is present said gradually increasing dimension opening, is generally rectangular in shape.

4. A wrench set holding system as in claim 1, in which said bottom and said top elements project in opposite directions from said primary body element.

5. A wrench set holding system as in claim 1, which further comprises means for securing said wrenches of said wrench set in said wrench set holding system.

6. A wrench set holding system as in claim 5, in which said means for securing said wrenches is a rod, which rod serves to sandwich shanks of said wrenches against an element selected from the group consisting of said primary body element and said bottom element, said rod being secured to said wrench set holding system by projection through loop means, said loop means being affixed to said wrench set holding system by the projection thereof through hole(s) in at least one element selected from the group consisting of said primary body element and said bottom element.

7. A wrench set holding system as in claim 6, in which said rod is secured to said wrench set holding system by two loop means, said two loop means being affixed to said wrench set holding system by projection thereof through hole(s) in at least one element selected from the group consisting of said primary body element and said bottom element; one of said two loop means being projected through central pivot means of a rotatable means for securing wrenches such that a larger dimension of said rotatable means for securing wrenches is caused to force said rod to more securely sandwich said wrench shanks when said rotatable means for securing wrenches is caused to rotate in one direction around said central pivot means, and said rotatable means for securing wrenches is caused to free-up sandwiched wrench shanks when caused to rotate around said central pivot means in the opposite direction.

8. A wrench set holding system as in claim 7 in which said central pivot means comprises a sleeve, around which sleeve said rotatable means rotates in use.

* * * * *